US005960998A

United States Patent [19]

Brown

[11] Patent Number: 5,960,998

[45] Date of Patent: Oct. 5, 1999

[54] INSULATED SPRAY BOTTLE

[76] Inventor: Don W. Brown, Apt. 201, 501 W. Franklin Ave., Minneapolis, Minn. 55405

[21] Appl. No.: 08/288,479

[22] Filed: Aug. 10, 1994

[51] Int. Cl.[6] ..... B67D 5/60

[52] U.S. Cl. ..... 222/131; 222/146.2; 222/183; 222/321.1; 222/372; 220/256; 220/665

[58] Field of Search ..... 222/383.1, 146.2, 222/146.6, 183, 372, 54, 131, 321.1, 385; 220/420, 461, 254, 256, 665

[56] References Cited

U.S. PATENT DOCUMENTS

| | | | |
|---|---|---|---|
| 3,225,954 | 12/1965 | Herrick et al. | 220/420 |
| 3,685,693 | 8/1972 | Iketani | 222/54 |
| 3,823,718 | 7/1974 | Tromovitch | 606/22 |
| 4,714,174 | 12/1987 | Williams | 220/254 |
| 4,932,563 | 6/1990 | Diamond et al. | 222/183 |
| 4,972,973 | 11/1990 | Davis | 222/131 |
| 5,000,384 | 3/1991 | Arnold | 269/128 |
| 5,119,974 | 6/1992 | Mann | 222/383.1 |
| 5,144,991 | 9/1992 | Wallroth et al. | 222/54 |
| 5,398,843 | 3/1995 | Warden et al. | 220/254 |

*Primary Examiner*—Andreas Kashinikow
*Assistant Examiner*—Lisa Ann Douglas
*Attorney, Agent, or Firm*—M. Stignani

[57] ABSTRACT

A spray bottle for maintaining and dispensing a non-ambient temperature fluid including an insulated container reducing heat transfer through the container surfaces and a hand powered spray mechanism attached to an opening at the top of the container. The spray mechanism attached to the container drawing fluid from the container with a pump through a straw which extends into the container. The pump expels the fluid received from the straw through an orifice and a diverging nozzle, thereby generating a spray output, the spray mechanism affixed to the opening.

12 Claims, 6 Drawing Sheets

INSULATED SPRAY BOTTLE

COPYRIGHT RESERVATION

A portion of the disclosure of this patent document contains material which is subject to copyright protection. The copyright owner has no objection to the facsimile reproduction by anyone of the patent document or the patent disclosure as it appears in Patent and Trademark Office patent files or records, but otherwise reserves all copyright rights whatsoever.

FIELD OF THE INVENTION

The present invention relates to the field of spray dispensers. More specifically, the present invention relates to an insulated spray dispenser for applying controlled temperature fluids in the field of hair and skin care.

BACKGROUND OF THE INVENTION

The technology of spray dispensers is used in several configurations. In PRIOR ART FIG. 1, a standard spray bottle 50 includes a single walled plastic container 52 holding a quantity of fluid and a spray mechanism 54 connected to an opening 55 in the container. The spray mechanism 54 includes a hand actuated mechanical pump 56 which draws the fluid up a connected straw 58 inserted into container 52, and forces the fluid through an orifice 60 creating a stream of fluid. This stream of fluid is modified in a number of dispenser configurations by a variable pitch nozzle 61 that changes the fluid stream into a mist. The straw 58 is typically a single plastic tube reaching to or near to an internal base of the container 52. Pump 56 typically is a piston style displacement pump with a spring return pump handle 62. Each time the spray handle 62 is compressed, the volume of fluid is driven out of the pump 56 to the orifice 60 which creates the stream of fluid drawn from the straw and an similar quantity of fluid is drawn up into the pump 56 through the straw 58 on the return stroke of the pump handle 62. A check valve 64 blocks the backward flow of fluid from the orifice 60 allowing the return stroke of the pump handle 62 to draw up more fluid from the container 52. Pump handle 62 is repeatedly actuated by the user until a sufficient quantity of fluid is dispensed.

Spray dispensing is used in many applications (i.e. cleaning fluids, fluid waxes, solvents) that require a generalized application of a fluid. Several uses for spray bottles have evolved in the skin and hair care industries as well in the personal comfort market. Spray bottles are commonly used to dispense water and other fluids onto the skin and hair of individual. However, the standard spray bottle has not provided an acceptable solution to dispensing specialized fluids or fluids that are most effective or comfortable at non ambient temperatures. In hair cutting, a stylist uses water alone or with other compounds to wet or condition a client's hair during cutting. Throughout the hair cut, fluid is periodically applied to the client's hair and facial area. Unfortunately, the fluid in the spray bottle is at an ambient temperature, which is typically too cold to the client when applied. In dispensing the fluid to the clients hair and face, the personal comfort of the client is compromised in order to effectively wet or condition the hair. Another comfort related use of the spray bottle is by individuals who are exercising or tanning in the sun. By applying atomized water to the skin, the user aids the body's own cooling system to cool or refresh the user. The problem encountered by those who use the same spray bottle over a period of time (i.e. fifteen to twenty minutes) find that the fluid inside the spray bottle has normalized to a near ambient temperature that is no longer refreshing or cooling. Additionally, the evaporative and hence the cooling qualities of water become limited during application on humid days.

Heated substances are commonly applied to the skin or hair in the hair care industry. Examples of these substances can include aromatherapy, hot oil treatments, conditioners and hair color fillers. Application of these substances is time and labor intensive, the client relying on the skill of the stylist to evenly apply the substances. Uneven application in substances can result in undesired results especially in the cases of color filler application. Other hair and skin care product application methods include a facial vaporizer or an electric pulverizer devices which both use steam vaporization to apply astringents, essential oils, plant extracts, herb teas or skin fresheners. These devices percolate steam through extracts, or materials to carrying, oils, chemicals, or fragrances on the steam vapor, which are then deposited by dispensing the steam vapor over or on the client's skin. Steam dispensation has inherent dangers of burning the skin if applied to the skin at a steam temperature. The steaming apparatus also requires extensive cleaning and maintenance to be used effectively. Many other hair and skin care substances have thermally dependent properties (i.e. viscosity or chemical effectiveness) requiring application at an elevated temperature. As an example, hair conditioning agents penetrate to the core of the hair shaft quickly when applied at an elevated temperature. These agents are currently heated by a heater or another external device to periodically reheat the fluid. This method is time consuming and imprecise. If the materials are overheated when applied to the client, they will burn or, cause strong discomfort to the person receiving the heated materials. Other methods of heating the substances on the client include heating caps which are placed on the client after the substance has been applied. The use of a heater for heating substances on the client's hair and skin is inefficient and requires substantial equipment and stylist expertise to adequately treat the client safely.

Therefore, a need exists to safely dispense non ambient temperature fluids onto the human body and on other temperature sensitive surfaces while maintaining the fluids heated or cooled effectiveness over a increased period of time.

SUMMARY OF THE INVENTION

A spray bottle for maintaining and dispensing a non-ambient temperature fluid including an insulated container reducing heat transfer through the container surfaces and a hand powered spray mechanism attached to an opening at the top of the container. The spray mechanism attached to the container drawing fluid from the container with a pump through a straw which extends into the container. The pump expels the fluid received from the straw through an orifice and a diverging nozzle, thereby generating a spray output, the spray mechanism affixed to the opening.

DETAILED DESCRIPTION OF THE INVENTION

Figure 1:
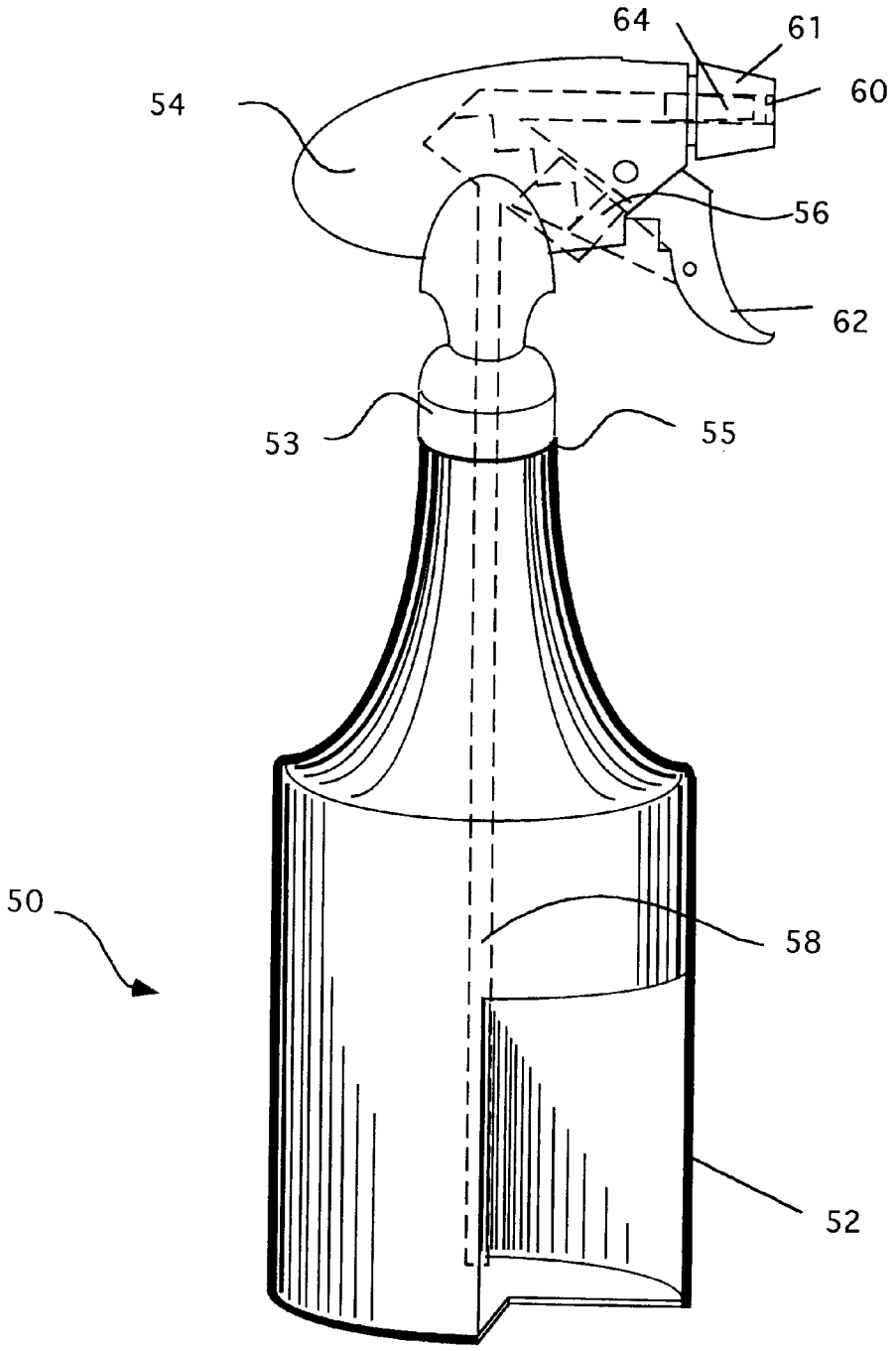
FIG.1 PRIOR ART
FIG. 1 is an example of a prior art spray bottle.
Figures 2, 2A:
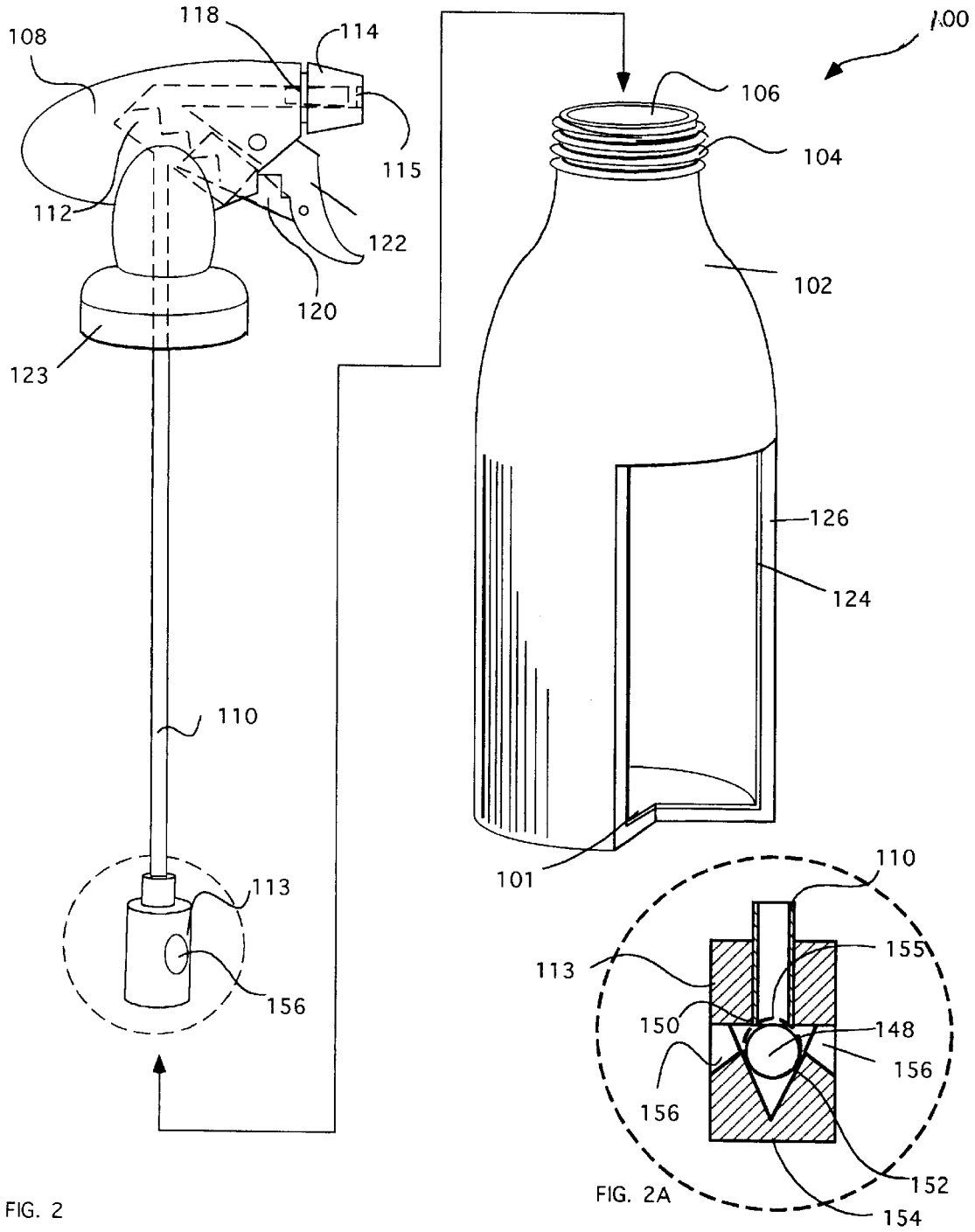
FIG. 2 is an exploded cut away view of a spray bottle of the present invention.
FIG. 2A is an inset sectional detail of a heat sensitive flow choke of the spray bottle of the present invention.
Figure 4:
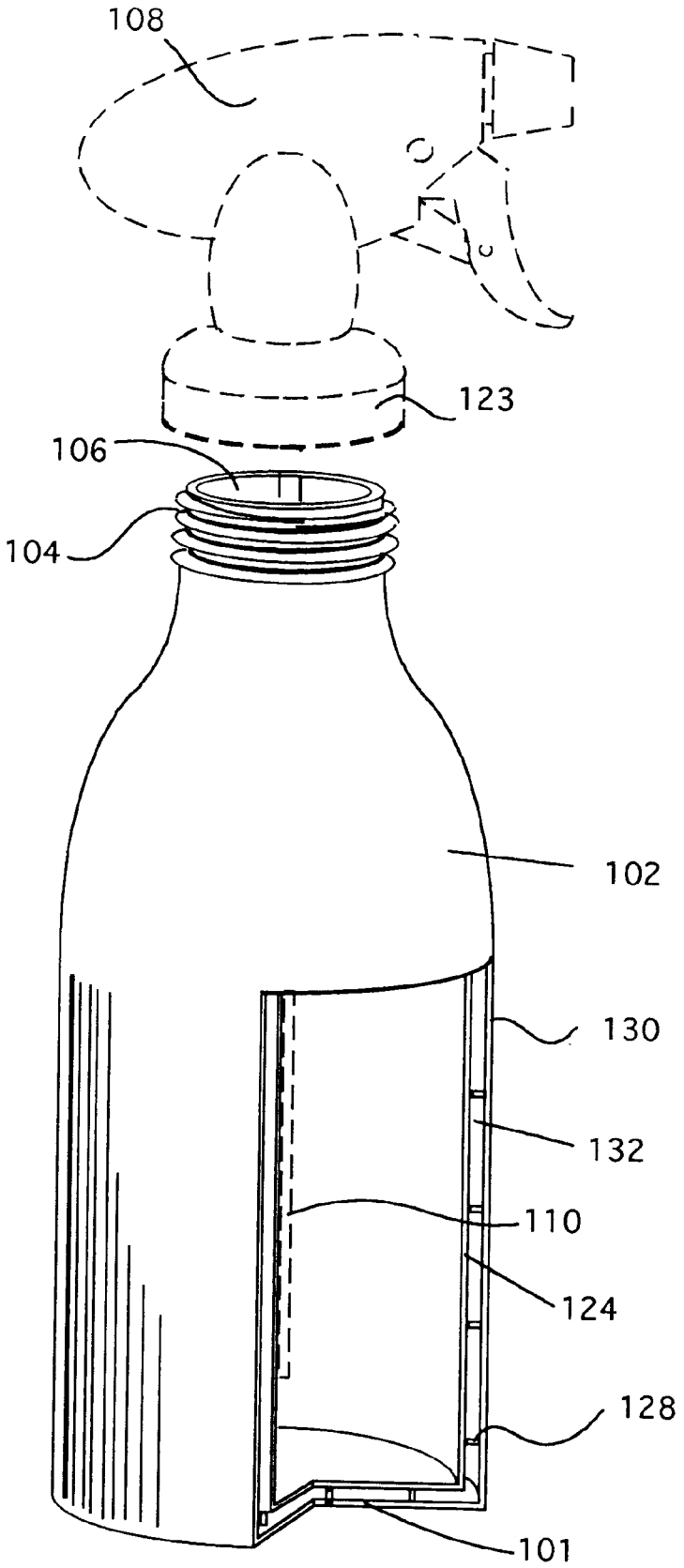
FIG. 4 is a cutaway view of the spray bottle of the present invention showing an insulator embodiment having a enclosing container insulator held apart by setoff posts.
Figure 5:
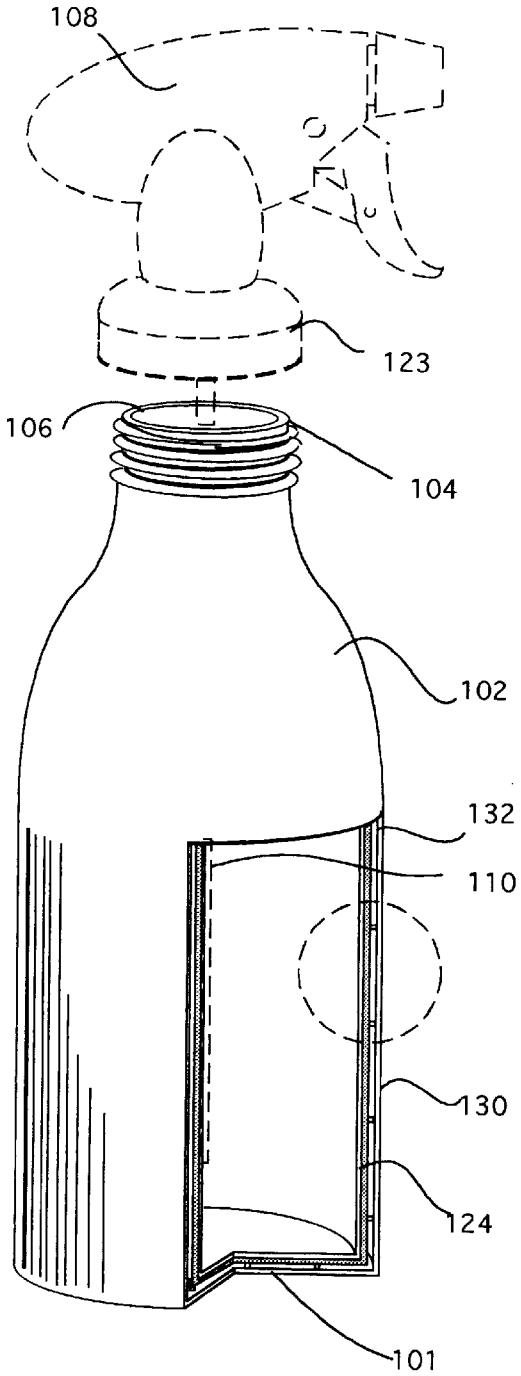
FIG. 5 is a cutaway view of the spray bottle shown in FIG. 4 with an additional insulator structure.
Figure 5A:
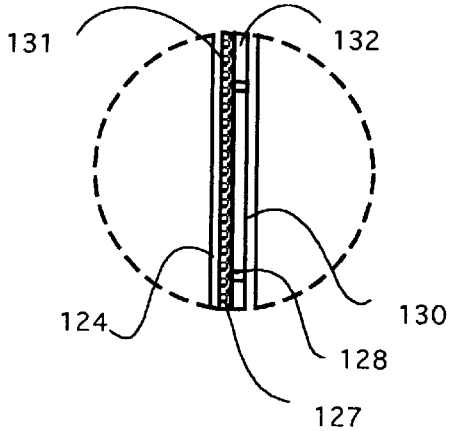
FIG. 5A is an inset sectional detail of the spray bottle shown in FIG. 5 showing the addition of a heatable insulator layer that retains heat in a fluid contained within the insulator layer.
Figure 5B:
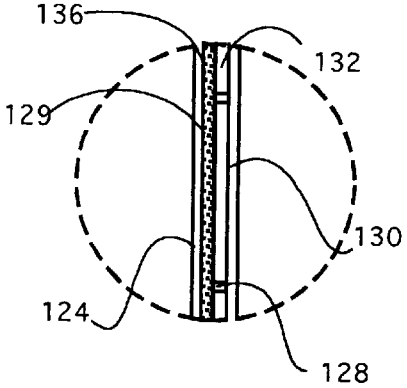
FIG. 5B is an inset sectional detail of the spray bottle showing the addition of a freezable insulator layer that retains cold in a fluid contained within the insulator layer.
Figure 6:
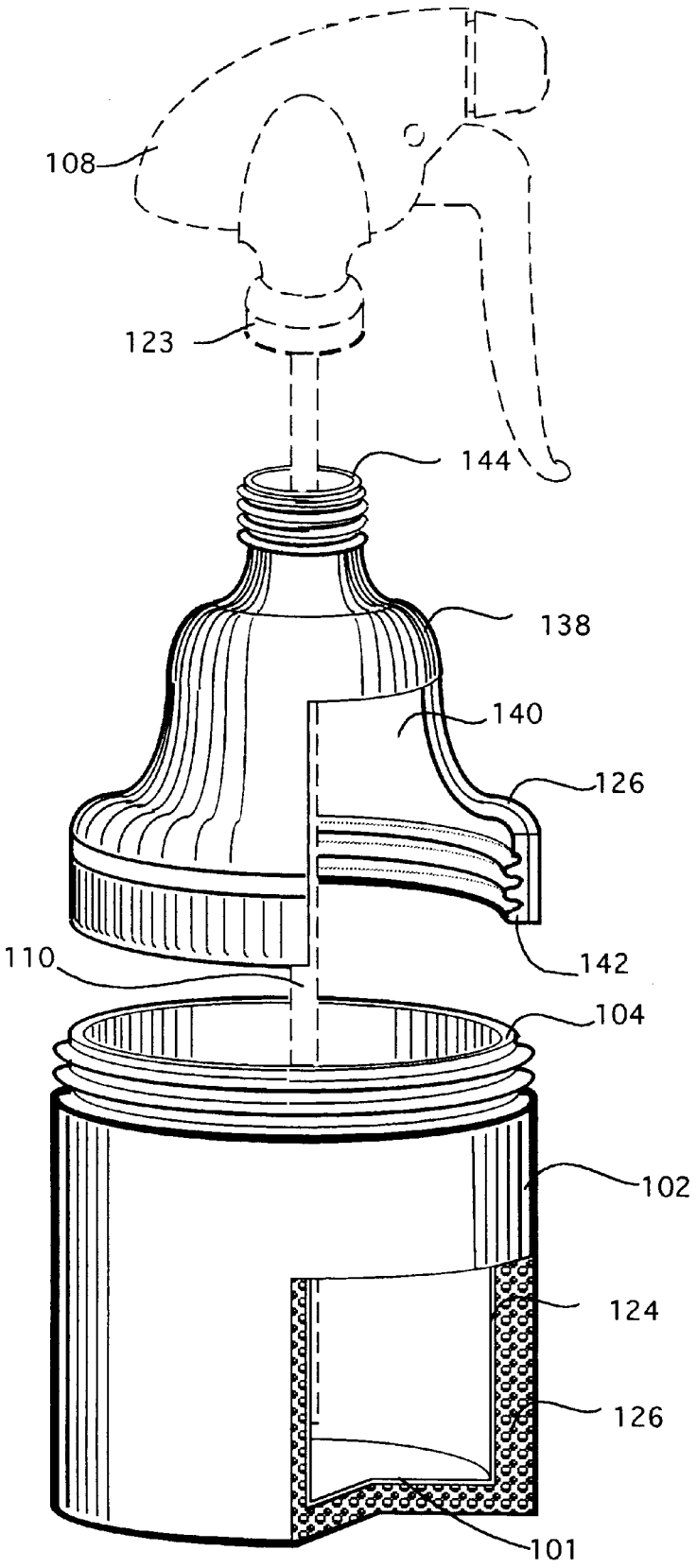
FIG. 6 is an embodiment of the spray bottle showing a modular insulated spray bottle of the present invention.

In FIG. 2, the present invention is a spray bottle 100, indicated generally, is used in dispensing non ambient temperature fluids. The spray bottle 100 also is used in holding non ambient temperature fluids at or near those non ambient temperatures over a period of time. The spray bottle 100 includes a container 102 having a threaded opening 104 in located at the top 106 of the container 102 and a spray mechanism 108 affixed to the threaded opening 104 on the container 102. The term wall as used in this specification also includes a base wall or bottom 101 to the container 102. Spray mechanism 108 includes a straw 110, a hand operated pump mechanism 112, an attachment cap 123 and a spraying apparatus 114. In FIG. 2A, straw 110 may include a heat activated choke 113 to prevent dispensation of fluids above a certain set temperature. Pump mechanism 112 includes pump mechanisms 112, a spring return plunger 120, and a pump handle 122. Spraying apparatus includes an orifice 115 which generates fluid stream from fluid expelled by pump mechanism 112. Container 102 includes a wall 124 and at least a single insulator 126 affixed to the container 102 so as to reduce the amount of heat transfer to or from the fluid that is held in container 102. In FIG. 4, specific embodiments of Insulator 126 is shown on container 102 including an enclosing container 130 which surrounds container 102 and is separated from the container 102 by a gap 132. FIGS. 5, 5A–B show container 102 embodiment which includes a second insulator 127 with modified structure to retain and distribute additional thermal energy to container 102. In FIG. 6, modular spray bottle 100 embodiment splits the container 102 into a modular container 102 and an adapter 138 for the utilization of various premixed solutions using the same spray apparatus 108.

Figure 3:
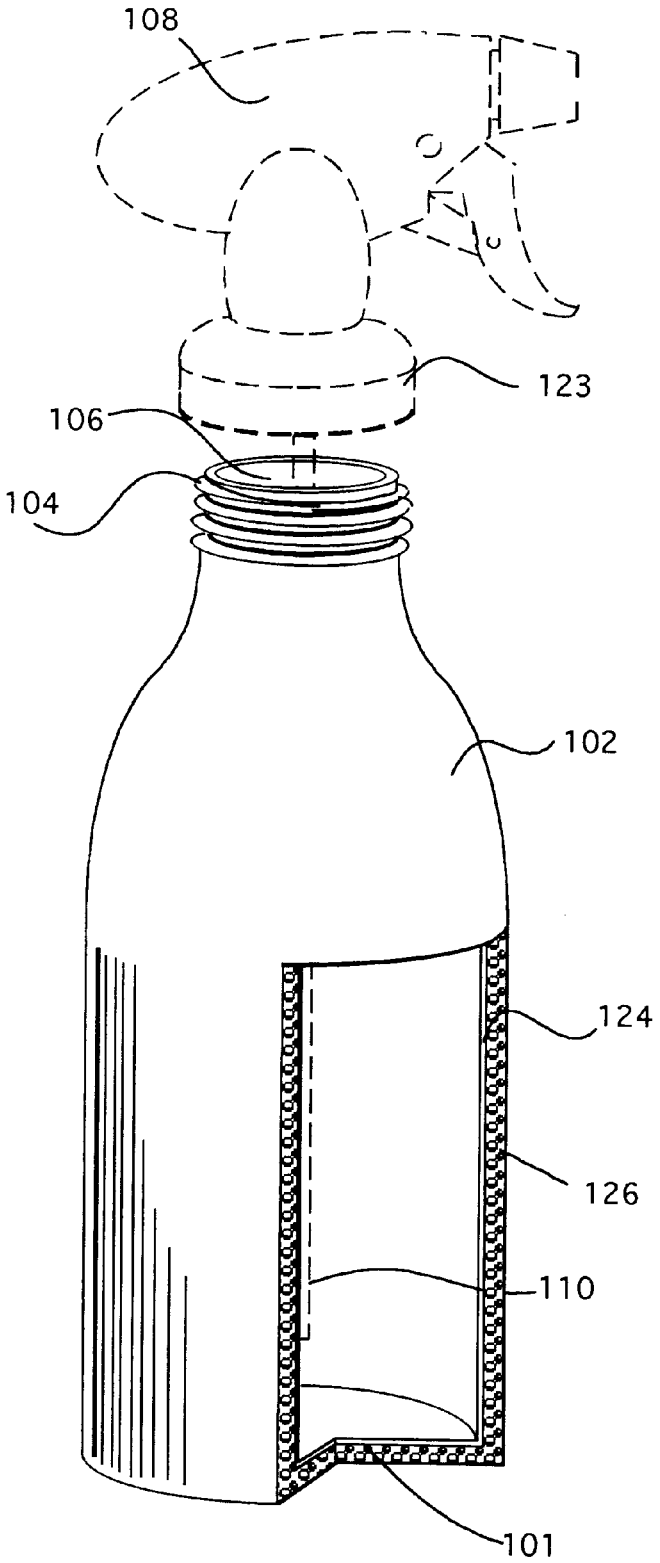
FIG. 3 is a cutaway view of the spray bottle of the present invention showing an insulator embodiment having a foam insulated exterior.

In FIGS. 2 and 3, container 102 includes a single walled container 102 constructed of molded plastic, polymers or the like. Container 102 is functionally covered by insulator 126 made from an insulating foam. Types of insulating foam include but are not limited to an open or closed cell neoprene, a foamed urethane, or other types of an elastic polymer sleeve that has sufficient insulative properties to limit the heat transfer of the fluid contained in the container 102. The insulator 126 in this embodiment is affixed to the container 102 by a variety of methods. Affixation methods include a foam layer sleeve that covers walls and base of container 102 which is held to container 102 by elastic tension or an adhesive, a sprayed on insulator 126 coating of foamed urethane, or a concurrent molding of the insulator 126 during the molding of the container 102. A standard spray mechanism 108 is utilized in this embodiment.

In FIG. 4, container 102 utilizes the container wall 124 and the enclosing container 130 as insulator 126 by providing a gap 132 between the two containers 102,130 which prevents conductive and most convective heat transfer. Enclosing container 130 connects to top 106 of container 102. If spray bottle 100 construction is not rigid enough to hold gap 132 distance constant, the internal wall 124 may be held away from the enclosing container 130 by a series of standoff posts 128 that maintain the gap 132 separation distance while allowing minimal heat transfer through standoff posts 128. The standoff posts 128 are constructed of low thermal conductivity materials and/or have a small cross sectional area to reduce heat transfer. An enhancement to the thermal insulation characteristics of this container 102 would be to make the wall 124 and the enclosing container 130 rigid enough to support the removal of air contained between the wall 124 and the enclosing container 130. The resulting vacuum or partial vacuum would prevent the convective heat loss due to air between the walls. Container 102 would then block nearly all heat transfer, but for radiation heat transfer. Radiation heat transfer may be minimized using effective non absorbing colors and coatings if the application requires.

In FIG. 5, container 102 has an additional insulator 127 included with gap 132. The addition of the additional insulator 127 has several advantages over the embodiments in FIG. 3–4. In this embodiment, container 102 is manufactured with a insulator 127 interposed between the containers 102, 130. The insulator 127 includes a material with a low thermal conductivity coefficient. To enhance the insulative characteristics of container 102, the enclosing container 130 is separated from the insulator 127 by a gap 132. The insulator 127 is affixed to the outer surface of wall 124. Gap 132 separation of the insulator 127 and enclosing container 130 is maintained by either standoff posts 128 as described or by the rigidity of enclosing container 130, insulator 127, and internal wall 124. Insulator 127 enhances the insulative characteristics of container 102 and provides structure for an additional heat transfer from storage in insulator 127 to wall 124 of the container 102.

Heat storage is accomplished by modification of the insulator 127 to hold additional heat capacity or heat sinking capacity. The modifications hold additional thermal capacity within the insulator 127 and passively transmit the thermal energy through wall 124. As shown in FIG. 5A, insulator 127 contains a fluid 131 having a thermal capacity, which when heated, will disperse heat over a time period. Insulator 127 surfaces are sealed to prevent the fluid 131 from contacting the enclosing container 130. Container 102 is constructed of heat resistant or microwave safe materials allowing container 102 to be heated. The container 102 is heated which in turn heats the fluid 131 within insulator 127. The heated fluid 131 in the insulator 127 transfers to the internal wall 124 of the container 102 as it is separated from the enclosing container 130 by gap 132. The resulting effect is an additional heat capacity in addition to that of a fluid in container 102.

The converse of the heatable insulator 127 is an embodiment of container 102 with an insulator 129 containing a chillable or freezable material 136 as shown in FIG. 5B. Examples of the chillable or freezable material include water or commercially available fluids 136 designed to be chilled or frozen before use. Container 102 will have an additional chilling capacity while still insulating container 102 contents from external heat. As with the heatable configuration of container 102, freezable material 136 is sealed within insulator 127 to maintain the integrity of the gap 132.

A modular embodiment of container 102 is shown in FIG. 6. Container 102 is split into an adapter sleeve 138 and a wide mouthed container 102. Adapter 138 and container 102 including insulators 126, 127 utilizing the all insulating embodiments shown in FIGS. 2–5 or the like. Threaded opening 104 is substantially the same diameter as the internal bore of container 102. Modular wide mouthed container 102 allows the containers 102 to be processed, heated or cooled separately from the spray mechanism 108, so the user of the spray bottle 100 can replace containers 102 as they are used without stopping to refill, reprocess, reheat or recool the same container 102. The wide mouthed design of this embodiment facilitates filling of the container 102 with materials or with a passive heating or cooling element. Examples of the heating or cooling elements would be ice, cold packs, or other commercially available items that help to keep the fluid hot or cold for a longer period. Wide mouthed container 102 has a separate cover (not shown) to allow separate storage of containers 102.

Adapter 138 connects the wide mouthed container 102 and a commercial spray apparatus 108 having a commonly used diameter threaded attachment 123. Adapter 138 is cylindrically shaped sleeve that widens at a first end 142 to attach to the wide mouthed container 102 and narrows at the other end 144 connecting to a standard or commercially available spray mechanism 108. The interior of adapter 138 has conduit 140 extending down through the center of the adapter 138. Conduit 140 is large enough to allow straw 110 from attached spray mechanism 108 to extend through adapter 138 into the bottom of the attached container 102. Adapter 138 is similarly insulated as the container 102. Adapter 138 allows operation of the spray bottle 100 to hold and operate the bottle 100 with a single hand (not shown) while insulating the hand from container 102 heat or cold. Adapter 138 is made from similar material as the container 102 to minimize heat expansion differences between adapter and container 102.

FIG. 2, and 2A shows spray mechanism 108 including straw 110 with heat activated choke 113, hand operated pump mechanism 112, and spraying apparatus 114. The present invention includes use of standard or commercially spray mechanism 108 or spray mechanisms 108 modified with choke 113. Operation of standard spray mechanism 108 is well known in the industry. Modification of spray mechanism 108 with choke 113 will not affect the normal operation of spray mechanism 108. Spray apparatus 114 may include only the orifice 115 and/or other spray producing apparatus. Other improvements to spray apparatus 114 will vary upon the desired application of the spray bottle 100.

Choke 113 includes an insert of heat sensitive material within the straw that will expand to close off straw 110 when subjected to a fluid hotter than a desired upper limit. FIG. 2A shows an embodiment of choke 113 including a ball 148 of material with a substantially large coefficient of thermal expansion trapped against a lower end 150 of straw 110. The size of the ball 148 is a function of the triggering temperature and straw end 150 size. As ball 148 is exposed to heat, expanding ball 148 will close off straw's 110 lower end 150 by expanding and compressing the ball 148 against straw end 150 as shown by a dashed line 155. The ball 148 achieves its compressive force by pushing against a base 154 of a housing 152 which holds the ball 148 close to the straw's 110 lower end 150. Once the temperature of the ball 148 is diminished to a point where the ball 148 shrinks, the ball 148 retracts into it's housing 152. The fluid flows into the straw 110 by an access channel 156 on either side of the choke 113. An example of ball 148 material is copper or aluminum or any other material with a sufficiently large coefficient of thermal expansion. The ball's 148 expansion must be matched to an upper yield limit of the straw 110 material. Lower end 150 of straw 110 must accept the ball 148 as a seal without ball 148 plastically deforming the straw 110. Once the straw 110 is deformed, the sealing function can degrade. Choke 113 can be affixed to standardized spray mechanisms 108 without modification to the straw 110. Choke 113 may be made integral to straws 110 designed specifically for dispensing elevated temperature fluids.

The benefits of a heatable safe insulated spray bottle 100 in the hair and skin care market are expansive. The ability to effectively and safely dispense a comfortably heated fluid to the skin of the client without constantly reheating or recombining the elements in the bottle 100 result in several benefits to the stylist.

The ease of having a modular supply of premixed and preheated containers 102 containing hair and skin care products allows the stylist to apply substances onto the client without special preparation or delay. Hair and skin care products may be prepared in batches maintaining quality and achieving uniform results from uniform mixtures. Time delays in preparation and application are reduced.

The safety created by using the flow choke 113 allows application spraying of heated fluids on a client's hair and/or skin without fear of being burned as the spray mechanism 108 will not function if the fluid is above a desired upper temperature. The spray bottle 100 achieves similar or superior application of fluids over the traditional vaporizer without the danger and mess associated with the use of steam.

Examples of hair and skin care products which are more effective when heated include hot oil treatments, conditioners, plant extracts, herbal teas and aromatherapy products. Hair structure becomes more receptive to perms or conditioners as these substances are sprayed on the hair at an elevated temperature. A hot oil treatment may be prepared in a microwave, applied by the spray bottle 100 achieving superior coverage and effect to the client's hair.

Massage oils that are preheated are also applied in a manner that enhances the comfort of the client receiving the massage. Oils can be preheated to a specific client desired heat level and dispensed throughout a massage that may last over an hour without an appreciable difference in oil temperature. Massage oils that contain fragrances also have an added benefit of aromatherapy when applied in a heated state. Substances that contain essential oils which are vaporized or activated by heat can be applied by the present invention.

In hair styling, it is common for the hair stylist to wet the client's hair periodically through out the hair cut with water. Water that is too cold causes the client discomfort and can detract from the haircut. An insulated spray bottle 100 could be used to dispense water or a premixed conditioning or styling solution that is preheated to a comfortable temperature. The hair stylist can utilize the fluid throughout the haircut without stopping to reheat the fluid or subjecting the client to an application of fluid that is too cold for the client's comfort level.

Another application of an embodiment of this invention would allow a sun bather or an person exercising to utilize the insulated container 102 and spray mechanism 108 to provide a cooling mist or a drenching shower over an extended period of time. In the case of a sunbather, the person using the present invention fills the container 102 with ice and water. The insulative quality of the container 102 provides the sunbather with a cool fluid to spray over their sunheated skin for an extended period. The added heat sinking capacity of the embodiment in FIG. 5B keep any liquid contained in the spray bottle 100 chilled for a longer period of time over the single walled spray bottles 50 or even other embodiments of the present invention. The sunbather can also apply skin care product in the same manner as in the hair salon. A mineral water solution including sun blocking substances, moisturizers, or fragrances could easily be pre-mixed and applied in a cooling and refreshing manner.

The exerciser uses the spray apparatus as a cooling tool as well. As the cooling requirements of the exercising athlete may be more extreme, the quantity of fluid dispensed would require a higher volume of fluid application than the sunbather. In this application the spray bottle 100 configuration should have a larger volume output than the other applications. As with the sunbather, the modular design lends itself to the creation of mixtures that enhance the cooling capabilities of the spray. A mixture of a highly evaporative fluid and water could provide enhanced evaporative cooling for an athlete even in humid environments where water by itself does not evaporate effectively.

In a more unusual application, wax used in body waxing applications can be melted and held by the insulated container 102 in its fluid state and sprayed on the client's skin rather than having the wax spread on with a spatula. In this application, the spray mechanism 108 must be constructed of materials that can be heated to remelt wax that may solidify in the straw, pump, or orifice. Safety and care must be exercised in this application. Due to the high level of cooling that fluid spray achieves as it is sprayed, wax can be kept as a liquid in the spray bottle 100 prolonging the time before reheating while still applying at a comfortable temperature to the client.

An industrial application of this concept outside the hair and skin care industry would use the insulated spray bottle 100 in the dispensation of temperature dependent compounds such as glues, or substances that are easily dispensed at elevated temperatures, but are highly viscous at ambient or near ambient temperatures. An insulated spray container 102 made from microwave safe materials could be pre-filled with the ambient viscous materials and then microwaved or heated prior to dispensation. The use of standard spray mechanisms 108 allow easy replacement of damaged or clogged spray mechanisms 108. The insulated container 102 and adapter 138 would keep the heat internal to the unit as well as allow a user the ability to hold the container 102 without special heat shielding equipment.

Insulated spray bottle 100 application can be extended to a usage of chemicals substances that are more effective when heated. An example of chemical substances include solvents and cleaning agents which are more effective when heated. The modularity of the insulated container 102 could again be used effectively to prepackage the solvents or cleaners and allow the user to merely heat the packages as needed.

The manner and content of the present invention disclosed herein is described with reference to preferred embodiments. Workers skilled in the art will recognize that changes may be made in form and detail without departing from the spirit and scope of the invention.

What is claimed:

1. A spray bottle, comprising:

a hand operated spray mechanism for drawing a quantity of fluid through a straw fixedly attached to the spray mechanism and then expelling the quantity of fluid to the atmosphere through an orifice;

a heat sensitive choke fixedly attached to the straw preventing fluid flow through the straw if the choke is heated above a desired temperature;

a container for containing fluid, the container having a threaded opening through which the straw and the heat sensitive choke are inserted and the spray mechanism is rotatably attached; and an insulator substantially conformably enclosing the container, the insulator reducing heat transfer through a surface of the container.

2. The spray bottle in claim 1 where the heat sensitive choke includes a ball which expands to close off the straw when the ball is heated above the desired temperature.

3. A modular spray bottle, comprising:

a hand operated spray mechanism for drawing a quantity of fluid through a straw fixedly attached to the spray mechanism and then expelling the quantity of fluid to the atmosphere through an orifice;

a cylindrical adapter having a first end and a second end, a conduit inside the adapter connecting the first end and the second end, the adapter widening from the first end to the second end, the first end attached to the spray mechanism with the straw inserted through the conduit;

a container for containing fluid, the container having a wide mouth opening attaching to the adapter second end; and an insulator substantially enclosing the container, the insulator reducing heat transfer through a surface of the container.

4. The spray bottle in claim 3 where the insulator substantially encloses the adapter.

5. The spray bottle in claim 3 where the insulator is a layer of foam.

6. The spray bottle in claim 3 where the insulator is a second enclosing container, the second enclosing container separated from the container surface by a gap.

7. The spray bottle in claim 6 where the insulator also includes a second insulator attached to the first container and the second insulator separated from the enclosing second container by a gap.

8. The spray bottle in claim 7 where the spray bottle is made of microwave safe materials.

9. The spray bottle in claim 8 where the second insulator includes a heatable fluid.

10. The spray bottle in claim 7 where the second insulator includes a freezable fluid.

11. The spray bottle in claim 5 where the straw includes a heat sensitive choke preventing fluid flow through the straw if the choke is heated above a desired temperature.

12. The spray bottle in claim 11 where the heat sensitive choke includes a ball which expands to close off the straw when the ball is heated above the desired temperature.

* * * * *